US005402933A

United States Patent [19]

Behrmann

[11] Patent Number: 5,402,933

[45] Date of Patent: Apr. 4, 1995

[54] RESEALABLE PACK HAVING A LOCKING GRIP-TAB CLOSURE

[75] Inventor: Veith Behrmann, Vevey, Switzerland

[73] Assignee: Nestec S.A., Vevey, Switzerland

[21] Appl. No.: 173,355

[22] Filed: Dec. 23, 1993

[30] Foreign Application Priority Data

Feb. 12, 1993 [EP] European Pat. Off. ..... 93102207

[51] Int. Cl.[6] ..... B65D 5/70

[52] U.S. Cl. ..... 229/231; 229/219; 229/234

[58] Field of Search ..... 229/217, 219, 231, 234

[56] References Cited

U.S. PATENT DOCUMENTS

| | | | |
|---|---|---|---|
| 1,541,143 | 6/1925 | Hoile | 229/231 |
| 1,947,865 | 2/1934 | Marsh . | |
| 2,132,741 | 3/1937 | Kyseth . | |
| 2,421,141 | 5/1947 | Carr | 229/231 |
| 2,508,193 | 5/1950 | Ringler | 229/231 |
| 2,848,152 | 8/1958 | Geiger, Sr. | 229/231 |
| 2,881,967 | 4/1959 | Ringler | 229/231 |
| 3,018,031 | 1/1962 | Ahlbor et al. | 229/231 |
| 3,048,324 | 8/1962 | Anderson | 229/231 |
| 3,306,514 | 2/1967 | Mackendrick | 229/219 |
| 3,971,506 | 7/1976 | Roenna | 229/234 |
| 4,312,450 | 1/1982 | Reil . | |
| 4,913,292 | 4/1990 | Field | 229/231 |
| 5,067,615 | 11/1991 | Davitian . | |
| 5,145,111 | 9/1992 | Gillin | 229/217 |

FOREIGN PATENT DOCUMENTS

| | | | |
|---|---|---|---|
| 615973 | 3/1961 | Canada | 229/217 |
| 1207982 | 2/1960 | France . | |
| 8908393 | 10/1989 | Germany . | |

*Primary Examiner*—Gary E. Elkins
*Attorney, Agent, or Firm*—Vogt & O'Donnell

[57] ABSTRACT

A pack, which has panels and flaps folded together for forming an enclosure having a plurality of connected sides, has a pack closure portion formed from portions of four contiguous sides in a portion whereat a first side and a second side converge to form a corner and extend between and separate a third and fourth side. The closure portion is defined from the remainder of the pack by a hinge line in the first side and by lines cut in each of the second, third and fourth sides so that upon tearing and separating the closure portion of the pack from the remainder of the pack at the lines on the second, third and fourth sides, the closure portion is hingedly connected to the first side of the remainder of the pack at the hinge line for opening and closing the pack. The second side of the closure portion also has a tab for gripping which, when the pack is closed, overlays the second side of the remainder of the pack, and a tab for locking is formed in the tab for gripping, the tab for locking being engageable in a slot positioned in the second side of the remainder of the pack overlaid by the tab for gripping.

12 Claims, 3 Drawing Sheets

RESEALABLE PACK HAVING A LOCKING GRIP-TAB CLOSURE

BACKGROUND OF THE INVENTION

This invention relates to a recloseable pack of folded cardboard for dry products.

Recloseable packs for dry products, such as spaghetti, are already known, Cf. for example U.S. Pat. No. 5,067,615. Although the pack according to this patent is recloseable, it has to be cut out in the form of a very complicated blank which involves several steps for folding and gluing, more particularly rotation of the blank. This configuration means that special machines have to be used to form the pack.

SUMMARY OF THE INVENTION

The present invention relates to a pack which comprises front and rear panels and side panels between the front and rear panels and flaps forming the top and bottom of the pack and having a recloseable closure substantially prismatic in shape with a hinge line on the top of the pack and precut lines on the front and rear panels which terminate at the hinge and at one of the side panels having a cut line.

The problem addressed by the present invention was to provide a recloseable pack for dry products which would only need fairly simple cutting and which could be assembled and glued on standard machines.

Accordingly, the present invention provides a pack of folded cardboard which is characterized in that, below the cut line of the above-mentioned side panel and integral therewith, the closure comprises a precut gripping tab with a locking tab designed to engage in a slot formed in a layer of cardboard situated on the side panel beneath the gripping tab.

DETAILED DESCRIPTION OF THE INVENTION

The pack according to the invention is normally made standard or recycled, plain or micro-corrugated cardboard. It is designed to accommodate dry products, such as pastas, foods for domestic animals, cereals, biscuits, or to receive a flexible inner bag containing milk-based powders, cocoa powder, etc. The advantage of the pack in the latter case is that it enables the powder to be directly dispensed without the consumer having to use a spoon.

On the other hand, the pack according to the invention is very practical for the consumer to use, as will be seen hereinafter with reference to the accompanying drawings.

The cutting lines of the front and rear panels are longer near the hinge line and the side panel than at the centre of the front and rear panels. The purpose of this is to minimize the risk of the pack opening during storage and transport. The gripping tab on the side panel normally has a width substantially half that of the side panel.

The locking tab is semicircular in shape because this shape provides for effective reclosing of the pack. Nevertheless, the locking tab may also assume other shapes.

The slot designed to receive the locking tab is rectangular in shape. To make the gripping tab easier to grip, a recess preferably, but not necessarily, semicircular in shape is provided beneath the tab on the side panel.

To ensure that the closure remains open when the pack is in use, a semicircular cutout is provided on the hinge line. This cutout is able to rest on the flap situated immediately below and thus keeps the pack open.

The closure may have an opening angle $\alpha$ (see FIG. 1) of 0° to 90° and preferably 40° to 50°.

Where the pack has an inner flexible bag, the opening angle may be around 45°. By contrast, where the pack has no inner bag, the opening angle is preferably smaller because this angle determines the filling level of the pack.

The invention is described in more detail with reference to the accompanying drawings.

DETAILED DESCRIPTION OF THE DRAWINGS

Figure 1:
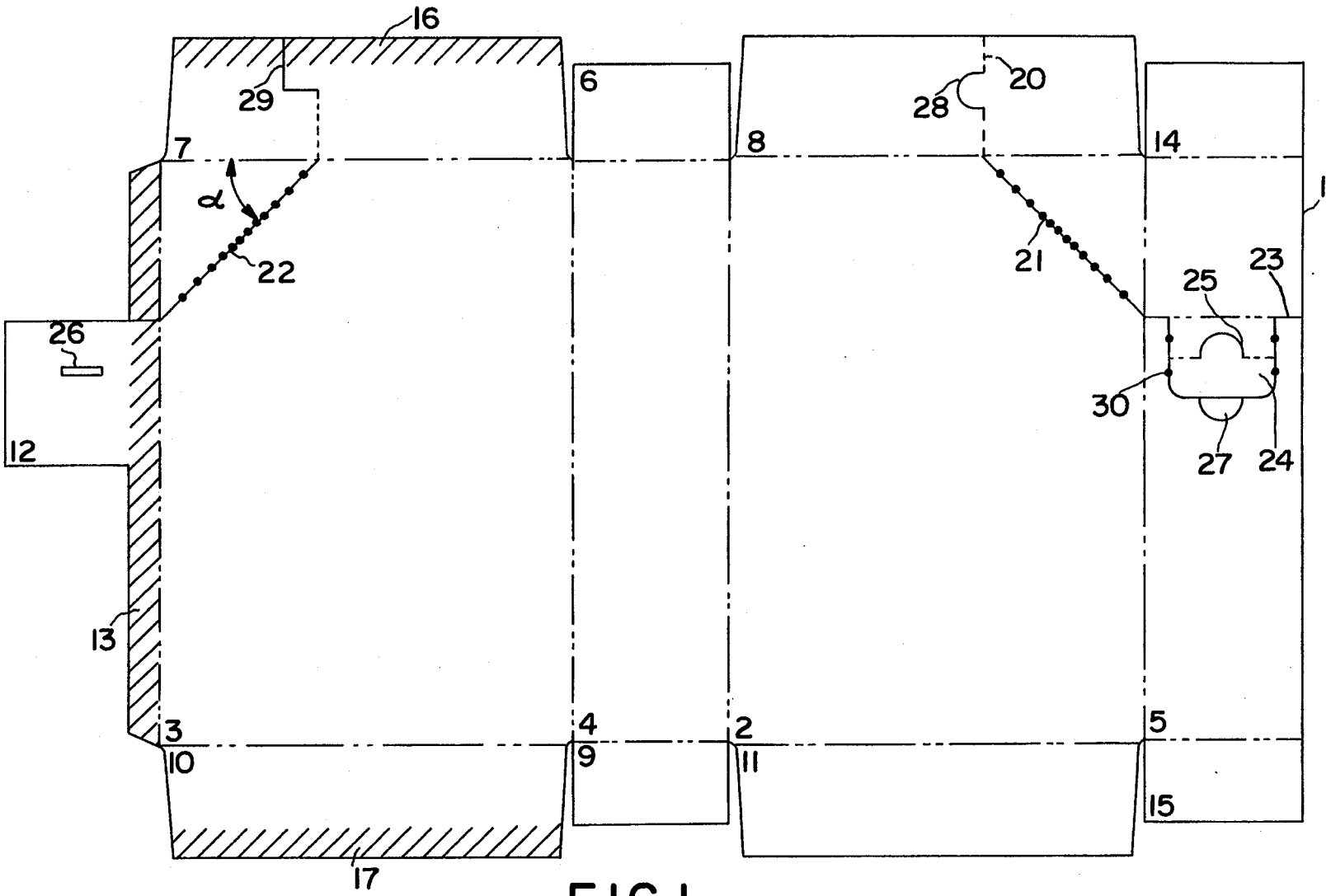
FIG. 1 is a plan view of a blank for the pack according to the invention.

In the drawings, the cut lines are shown as continuous lines, the precut lines as a continuous line with dots representing the non-cut zones and the folding lines as continuous dashes followed by two dots. The gluing zones are represented by cross-hatching.

As illustrated in FIG. 1, the blank (1) of the pack according to the invention comprises front and rear panels (2,3), side panels (4,5) and flaps (6,7,8,14) for forming the top and flaps (9,10,11,15) for forming the bottom of the pack. The panel (12) is designed to be situated below the panel (5) during folding. To construct the pack as shown in FIG. 2, the panels (5) and (12) of the FIG. 1 blank are glued along the gluing zone (13), the flaps (6,14,7 and 8) are folded and glued along the zone (16) and the flaps (9,15,10,11) are folded and glued along the zone (17) after the contents have been introduced.

Figure 3:
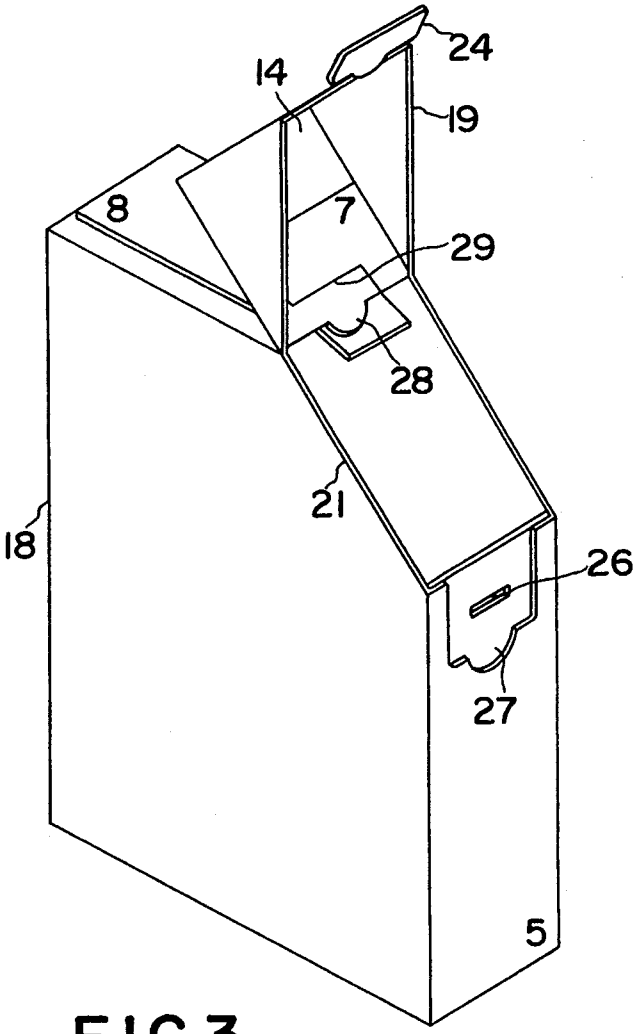
FIG. 3 is a perspective view of the pack in its open position.
Figure 2:
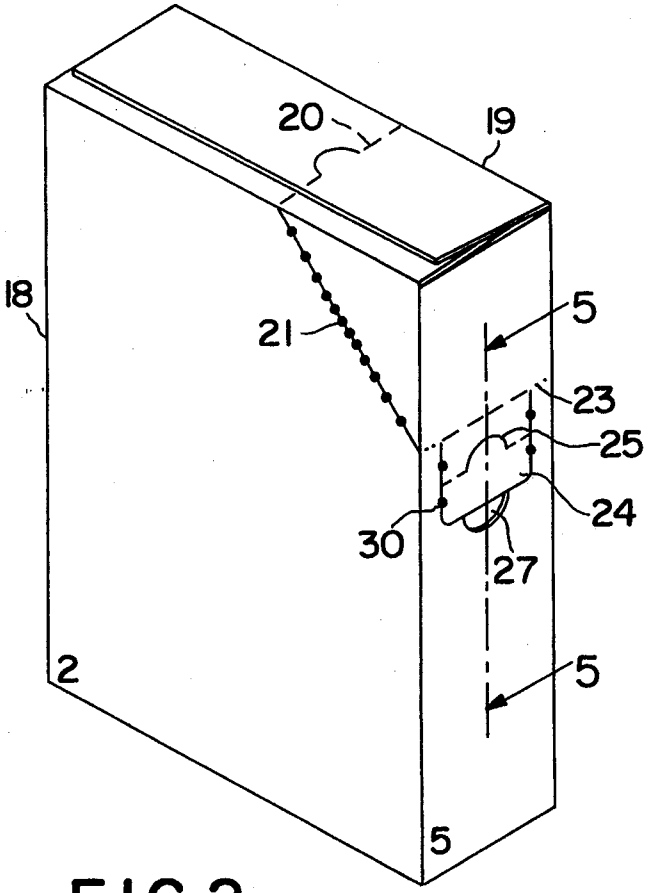
FIG. 2 is a perspective view of the pack according to the invention in its closed position.
Figure 6:
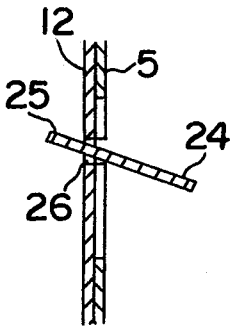
FIG. 6 is a section on the line 6—6 of FIG. 4.
Figure 4:
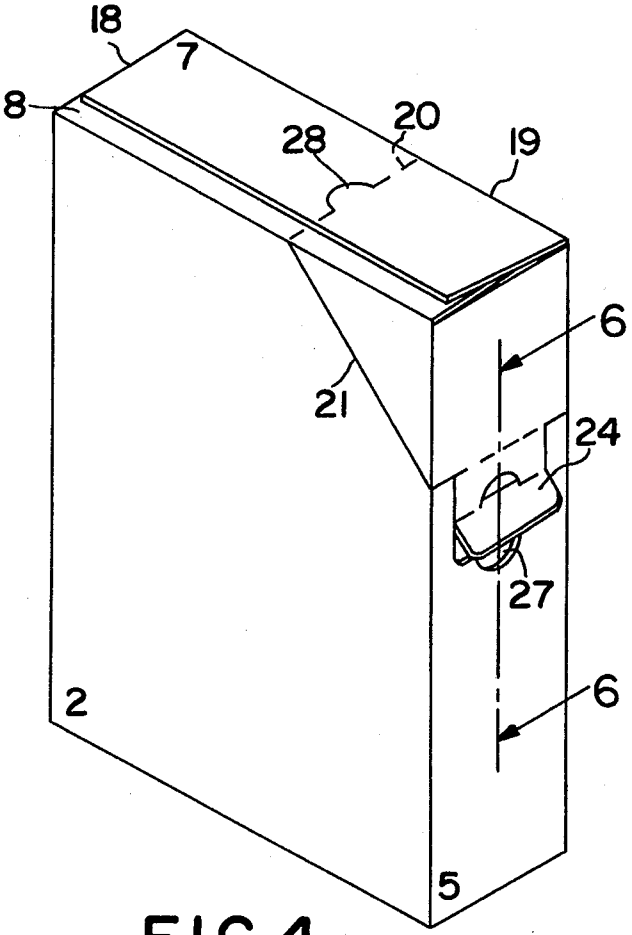
FIG. 4 is a perspective view of the pack according to the invention in its reclosed position.

The pack (18) shown in FIG. 2 comprises a closure (19) substantially prismatic in shape with a hinge line (20) and precut lines (21,22) which, as illustrated, have cuts which are shorter at the central portion of each line that at the end portions of each line. The precut lines (21, 22) terminate at a precut line (23) of the lateral panel (5), and a fold line for gripping tab (25) extends between the two portions of precut line (23) and thereby defines an interface between cover portion (19) and the gripping tab (25). Situated beneath this precut line is a gripping tab (24) precut along a line (30) comprising a locking tab (25) designed to engage in the slot (26) of the panel (12) situated beneath. A recess (27) is positioned beneath the gripping tab (24) to make it easier to grip. As illustrated in FIGS. 3, 4 and 6, semicircular cutout (28) is provided on the hinge (20) of the upper flap (8), bearing against the other flap (7) in the open position of the pack. A cutout (29) is formed in the flap (7).

A pack (18), as illustrated in FIGS. 2–4, is obtained by folding and gluing together the panels (2, 3, 4, 5, 12) and flaps (6, 7, 8, 9, 10, 11, 14, 15) of the blank (1) of FIG. 1, the pack thereby forming an enclosure having a plurality of connected sides and including four contiguous sides wherein a being positioned for closing the pack, extends from a position adjacent the closure portion second side and which contains the slot (26) which, in turn, is positioned so that upon the closure portion (19) being positioned for closing the pack, the gripping tab (24) overlays and covers the slot (26). The locking tab (25) is formed from and configured and positioned in the gripping tab (24) for, upon the closure being positioned for upon closing the pack, engaging the slot (26) for locking the gripping tab (24) and closure to the remainder of the pack.

Figure 5:
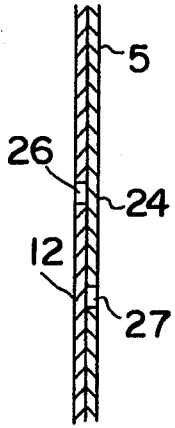
FIG. 5 is a section on the line 5—5 of FIG. 2.

As illustrated in FIG. 5, two pack panels (5, 12) overlay one another to form the second side of the pack, and the closure portion second side and the gripping tab (24) and the recess (27) and hence the locking tab are formed by one panel which forms an exterior of the pack, and the slot (26) is formed in the other panel.

As also illustrated, the gripping tab (24) terminates in an edge which extends between the third and fourth sides and the recess (27) positioned in the second side of the remainder of the pack extends from the tab edge in a direction away from the corner (see FIG. 4).

To open the pack, the user presses the panels (2,3) at the cut and precut lines (21,22) to tear them. The user then pulls the gripping tab (24) to tear it along the precut lines (30,23). The closure (19) may then be raised into the position shown in FIG. 3. By virtue of the cutout (29) in the flap (7), the semicircular cutout (28) is able to bear against the flap (7) to ensure better opening of the pack. The user may then pour out the contents of the pack (18). To reclose the pack (FIG. 4), the closure (19) is pushed downwards and the locking tab (25) is engaged in the slot (26). The invention thus provides a recloseable pack which is easy to use and which keeps its contents dry.

I claim:

1. In a pack having panels and flaps folded together for forming an enclosure having a plurality of connected sides and which includes four contiguous sides wherein a first side and a second side converge to form a corner and extend between and separate a third side and a fourth side, the improvements comprising:

a hinge line positioned in the first side and lines cut in each of the second, third and fourth sides, wherein the hinge line is at a position displaced a distance from the corner and extends between the third and fourth sides, wherein the second-side line is at a position displaced a distance from the corner and extends between the third and fourth sides, wherein each of the third-side line and fourth-side line extends from the second-side line towards the first side to a position adjacent the hinge line and wherein the second-, third-, and fourth-side lines are cut for tearing and separating, at the lines, a closure portion of the pack from a remainder of the pack so that upon tearing and separating the closure portion from the remainder, the second, third and fourth sides of the closure portion separate from the remainder of the second, third and fourth sides of the pack and the first side of the closure portion is hingedly connected to the first side of the remainder at the hinge line for opening and closing the pack;

a second side portion of the remainder of the pack which, upon the closure portion being positioned for closing the pack, extends from a position adjacent the closure portion second side;

a first tab which is integral with and extends from the second side of the closure portion in a direction away from the corner for providing a tab for gripping and so that upon the closure portion being positioned for closing the pack, the first tab overlays the remainder second-side portion;

a slot which is formed and positioned in the remainder second-side portion so that upon the closure portion being positioned for closing the pack, the slot is overlaid by the first tab; and a second tab formed from a portion of the first tab and configured and positioned for, upon the closure portion being positioned for closing the pack, engaging the slot for locking the first tab and closure to the remainder of the pack.

2. A pack according to claim 1 wherein the first tab terminates at a tab edge which extends between the third and fourth sides and further comprising a recess positioned in the second side of the remainder of the pack adjacent the tab edge and extending from the tab edge in a direction away from the corner.

3. A pack according to claim 2 wherein the pack second side is formed of a first panel and a second panel wherein the first panel overlays the second panel and forms an exterior of the pack and the closure portion second side, the first and second tabs and the recess are formed in the first panel.

4. A pack according to claim 3 wherein the slot is formed in the second panel.

5. A pack according to claim 1 or 2 wherein the slot is rectangularly shaped and extends lengthwise between the third and fourth sides and wherein the second tab is semi-circular in shape.

6. A pack according to claim 1 or 2 further comprising a fold line which defines an interface between the closure portion second side and the first tab.

7. A pack according to claim 1 wherein the first tab extends for a distance between the third and fourth sides which is substantially half of a distance of the second side between the third and fourth sides.

8. A pack according to claim 1 or 2 wherein the first side further comprises a semi-circular portion cutout recess which extends from the hinge line between the third and fourth sides and in a direction away from the corner.

9. A pack according to claim 8 further comprising a fold line which defines and interfaces between the closure portion second side and the first tab.

10. A pack according to claim 1 wherein the third-side and fourth-side lines have cuts which are shorter at a central portion of each line than at end portions of each line.

11. A pack according to claim 1 wherein the pack is made of cardboard.

12. A pack according to claim 11 wherein the cardboard is selected from the group consisting of standard, recycled, plain and microcorrugated cardboard.

* * * * *

UNITED STATES PATENT AND TRADEMARK OFFICE

CERTIFICATE OF CORRECTION

PATENT NO. : 5,402,933

DATED : April 4, 1995

INVENTOR(S) : Veith BEHRMANN

It is certified that error appears in the above-indentified patent and that said Letters Patent is hereby corrected as shown below:

Thus, the lines are configured and positioned so that, upon tearing and separating the pack at the lines cut in the pack, the second, third and fourth sides of the closure portion separate from the second, third and fourth sides of the remainder of the pack and so that the first side of the closure portion is hingedly connected to the first side of the remainder at the hinge line, thereby providing a hinged closure portion (19) (see Fig. 3) distinct from the remainder of the pack for opening and closing the pack.

The gripping tab (25) is integral with the closure second side and as best illustrated in Fig. 4 and 5 (and see Fig. 3), extends to overlay a portion of the second side of the remainder of the pack which, in turn, upon the closure portion--,

UNITED STATES PATENT AND TRADEMARK OFFICE

CERTIFICATE OF CORRECTION

PATENT NO. : 5,403,933
DATED : April 4, 1995
INVENTOR(S) : Veith BEHRMANN

It is certified that error appears in the above-indentified patent and that said Letters Patent is hereby corrected as shown below:

Column 3, line 1, after "a", insert:

--first side and a second side converge to form a corner and extend between and separate third and fourth pack sides.

As illustrated, the hinge line (20) is positioned in the first pack side, and lines (21, 22, 23, 30) are cut in each of the second, third and fourth sides. The hinge line (20) is positioned at a position displaced from the corner formed between the first and second sides and extends between the third and fourth sides, and the second-side line (23, 30) is displaced a distance from the corner and also extends between the third and fourth sides. Each of the third-side line (21) and the fourth-side line (22) extends from the second-side line (23, 30) towards the first side (i.e., towards fold lines (7, 8)) to a position adjacent the hinge line (20).

UNITED STATES PATENT AND TRADEMARK OFFICE

CERTIFICATE OF CORRECTION

PATENT NO. : 5,402,933
DATED : April 4, 1995
INVENTOR(S) : Veith BEHRMANN

It is certified that error appears in the above-indentified patent and that said Letters Patent is hereby corrected as shown below:

Column 4, line 3 (line 28 of claim 1), insert a hyphen between "second" and "side".

Signed and Sealed this

Thirteenth Day of June, 1995

*Attest:*

*Attesting Officer*

Bruce Lehman

BRUCE LEHMAN

*Commissioner of Patents and Trademarks*